United States Patent [19]

Markus

[11] 4,404,770

[45] Sep. 20, 1983

[54] SLIDING DOOR CONSTRUCTION FOR CLOSING AN OPENING IN A WALL

[75] Inventor: Jan J. G. Markus, Krimpen aan den IJssel, Netherlands

[73] Assignee: Markus Heretische Deuren B.V., Netherlands

[21] Appl. No.: 260,751

[22] Filed: May 5, 1981

[30] Foreign Application Priority Data

Aug. 21, 1980 [NL] Netherlands ..... 8004733

[51] Int. Cl.[3] ..... E05D 15/56

[52] U.S. Cl. ..... 49/235; 49/409

[58] Field of Search ..... 49/231, 224, 225, 234, 49/235, 409, 410; 160/19, 38, 39

[56] References Cited

U.S. PATENT DOCUMENTS

| | | | |
|---|---|---|---|
| 394,774 | 12/1888 | Kling | 49/409 |
| 2,597,578 | 5/1952 | Ganter | 160/38 |
| 3,276,166 | 10/1966 | Markus | 49/410 |
| 3,473,266 | 10/1969 | Miller | 49/409 X |
| 3,611,637 | 10/1971 | Saino | 49/235 |

*Primary Examiner*—Kenneth Downey

*Attorney, Agent, or Firm*—Bacon & Thomas

[57] ABSTRACT

A sliding door construction including a door provided with rollers at its upper edge, which rollers are supported for rolling along a V-shaped portion of a guide rail having recesses adjacent the locations of the rollers in the closed position of the door for moving the door slightly downwards and towards the wall just before reaching its closed position. The guide rail is provided at one block for arresting the sliding movement of the door and a detachable cover for concealing the rollers and the upper edge of the door from view.

10 Claims, 2 Drawing Figures

SLIDING DOOR CONSTRUCTION FOR CLOSING AN OPENING IN A WALL

Figure 1:
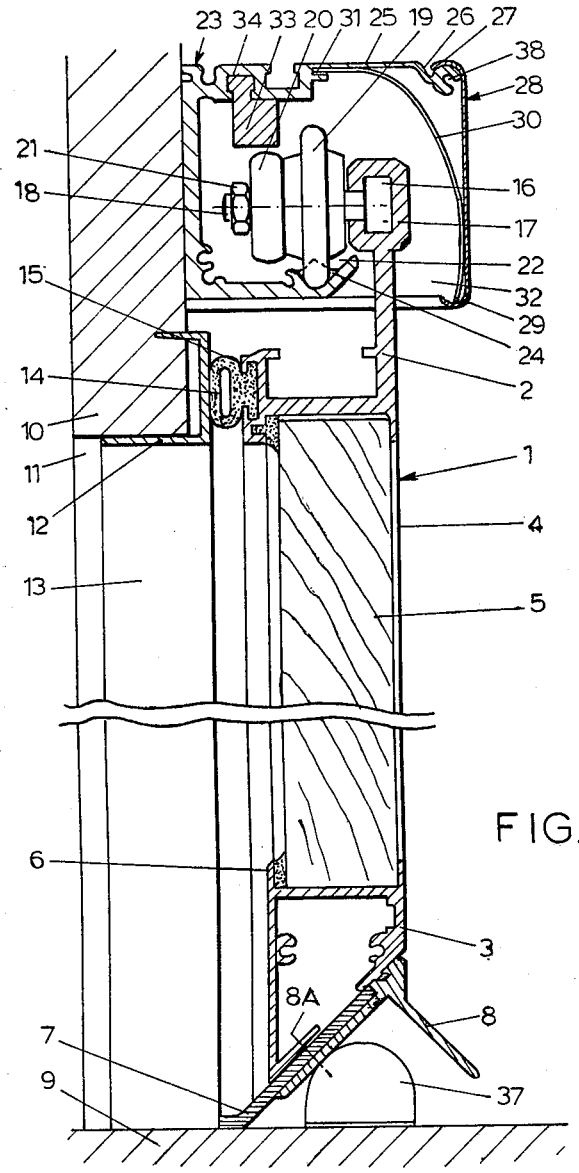

A sliding door construction for closing an opening in a wall.

The invention relates to a sliding door construction for closing an opening in a wall, wherein the sliding door is provided with rollers mounted on its upper edge for movement in a plane parallel to and spaced from the wall. The rollers are supported by and roll along a guide rail which is secured to the wall. The guide rail is provided with recesses for receiving the rollers situated in the closed position of said door so that the sliding door will move slightly downwards and towards the wall just before the door reaches its closed position.

In its closed position said sliding door will rest against the side edges of the opening in the wall and possibly against the floor on which the wall rests. When the door is opened, the rollers first slightly move obliquely upwards, so that the sliding door is freed entirely from the wall and from the floor and can easily be slid further. By such construction, a good sealing is obtained between the sliding door and the wall, and possibly the floor, whereas a stable final position of the sliding door is also obtained.

A sliding door construction of this type is known from the Dutch patent specification No. 110.557. According to this patent specification the rollers are provided in obliquely positioned legs of a guiding rail, with the legs being standing normal to each other.

The invention provides a more simple construction. This is obtained by providing a guide rail wherein the rollers, being mounted to the door in its vertical plane, are disposed to roll in a V-shaped portion of the guide rail which also includes the aforementioned recesses.

As such sliding door constructions are used frequently in environments such as hospitals, it is desirable that the upper edge of the door with the rollers mounted thereon be hidden from view as much as possible. In practice, it is desirable to provide the guide rail with an upper wall and a front wall extending downwardly from the upper wall to a point below the upper edge of the sliding door.

It is the purpose of the present invention to overcome this drawback by providing a construction which is characterized in that the sections of the guide rail which hide the rollers and the upper edge of the door from view are formed by a cover which is loosely connected to the rail and mounted in a vertical plane. The upper edge of the cover is curled, the terminal edge of this curl being fitted in a slot provided in the upper surface of the guide rail. The lower edge of the cover engaging resilient means which are connected to the guide rail for securing the cover in place with respect to the guide rail.

Essentially, the front wall of the cover may be an integrated part of the guide rail or been made removable in such a way that no bolts, screws or other such means have to be unscrewed for removing the cover. In this way, a fast assembly and also disassembly of the cover is made possible.

According to a further feature of the invention, the resilient means for securing the cover are formed by strips made in the desired shape. A number of such strips are mounted at a right angle to the cover, wherein each strip includes one end that grips into a curl provided at the lower edge of the cover and another end that fits in a longitudinal slot in the guide rail.

Because of the manner in which the one end of the strip is secured in the guide rail, the strip will assume a position wherein the lower curled edge of the cover is maintained in place. However, as the strip is slightly resilient, it can be removed easily from the curled edge of the cover. This permits the cover to be brought upwards slightly so that the curled upper edge can be removed from the slot in the upper surface of the guide rail.

In most cases, the guide rail will not have to be of a length wherein the rail fits closely between two walls which are at a right angle to the wall provided with the opening. In this case, either the rail can be made longer, or the end of the rail can be covered by a separate plate in order to maintain an aesthetic appearance.

The invention offers a simple solution for this purpose, in that the cover is provided with a least one squarely bent section for closing off the end of the guide rail. As this squarely bent section is only of a small length, a separate supporting of this section is not necessary.

The known sliding door construction is already provided with means, connected with the guiding rail, for slowing down the door in at least one of the final positions. With the known construction these means are formed by an obliquely disposed surface against which a roller of the door runs in such a way that the front roller of the door is pressed downwardly against the rail. This avoids tilting of the door in its plane because of its moving mass.

A drawback of this construction is, however, that the means for slowing down the door acts on the roller which, because it rolls over the rail, is turned into a certain direction. Thus the roller is subject to wear, particularly since such rollers are made of synthetic material in most cases.

The invention overcomes this drawback in that a ball bearing is mounted on the same shaft on which a roller is mounted or on a shaft parallel thereto. The bearing may engage a block of resilient material provided with an oblique side or with a recess to the ball-bearing. The outer casing of a ball-bearing is usually made of steel and thus has a good resistance to wear, so that this outer casing can roll along the slowing down means, thereby reducing friction between the parts.

For an easy assembly of the roller and the ball-bearing, the upper edge of the door may comprise a profile including a C-shaped slot into which the head of a tee bolt can be a slid and onto which the roller with the ball-bearing can be mounted.

Such a construction permits placing the two rollers in accordance with the distance between the recesses provided in the guide rail. Thus it is no longer necessary to first accurately measure the position of the two recesses in the rail in order to mount the rollers at the right places on the door.

Thus much time will be saved when mounting or replacing the rollers on the door.

Also the position of the block of resilient material which serves to slow down the door can be easily adjusted in the longitudinal direction of the guide rail. This is possible because the block is mounted on the guide rail by means of a C-shaped slot provided in the longitudinal direction of the guide rail.

The block can be connected to the guide rail in different ways. The block may, for example, be itself provided with projecting parts which fit into the C-shaped slot, such as a T-bolt and a metal part secured at the rear wall of the block. It is of course also possible to secure the block directly to this metal part.

Figure 2:
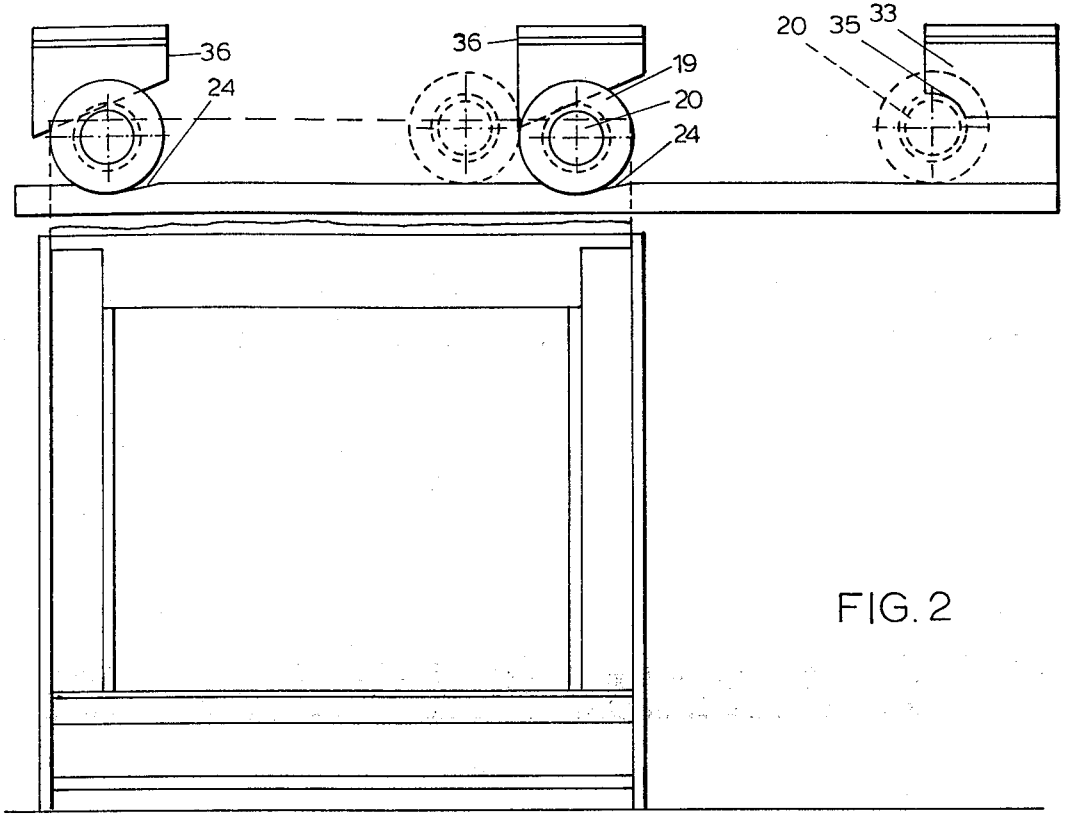

The invention will now be explained with reference to an example of an embodiment shown in the drawing, in which:

FIG. 1 shows a cross section over a sliding door construction and a part of the wall in which the opening to be closed by the door is provided, and FIG. 2 schematically shows a view of a part of the door construction of FIG. 1 and of some further construction parts.

The door 1 shown in the drawing consists of the upper profile 2, the lower profile 3, the side profiles 4 and the panel 5 incorporated between these profiles, the sealing between the panel 5 and the profiles being assured by the strip 6 of sealing material. It is possible of course to use a number of panels instead of one single panel 5, in which case further profiles are incorporated in the horizontal and/or vertical direction between the profiles 2, 3 and 4. The connection between the individual profiles may be accomplished in any known way.

On the lower profile 3 is a sealing strip 7 secured thereto by means of the profile 8, the latter being connected to the profile 3 by means of screws 8A and a tongue and groove interlock.

In the closed position of the door 1, as shown in FIG. 1, the sealing strip 7 is pressed against the floor 9 on which the wall rests, with the opening 11 to be closed by the door being delimited by the upper beam 12 and the side beams 13.

The sealing profiles 14 are provided in slots 15, the latter forming a part of the upper profile 2 and the side profiles 4 which serve for closing the door with respect to the beams 12 and 13.

The profile 2 is further provided with a C-shaped slot 16, in which the head 17 of a bolt 18 can be accomodated. The bolt can be mounted at any place along the longitudinal direction of the slot 16. On the bolt 18 are provided the roller 19 and the ball-bearing 20, which are held on the bolt 18 by means of the nut 21. Obviously this is done in such a way that the roller 19 is permitted to rotate.

The roller 19 rolls in a V-shaped slot 22 of the guide rail 23, which slot 22 is provided with recesses 24, as also shown in FIG. 2.

In the closed position of the sliding door as shown in FIG. 1, the rollers 19 are in the recesses 24 and it will be obvious that when the rollers 19 move from the slot 22 in the recesses 24, the door 1 will move both slightly downwards, in the direction of the floor 9, and to the left, in the direction of the wall 10, so that the sealing strip 7 and the sealing profiles 14 will assure a good sealing of the opening in the wall.

The guide rail 23 has an upper wall 25 and a slot 26 at the free edge thereof for receiving the curled edge 27 of the cover 28. The cover 28 extends approximately vertically downwardly and ends in a lower curled edge 29. A number of bent strips 30 serve to maintain the cover 28 in its place. Each strip has one end disposed in a slot 31 in the upper wall 25 of the guiding rail 23 and the other end disposed in the curled edge 29 of the cover 28. In this way a very simple securing of cover 28 is obtained so that it can also be mounted and removed easily.

The flexibility of cover 28 also contributes to its easy assembly and removal.

For sealing the end of the guide rail 23, the cover 28 is provided with a squarely bent section 32. The providing of one or more squarely bent sections 32 depends on the placement of the rail 23 with respect to the walls which are at a right angle to the wall 10.

For slowing down the sliding door a block 33 of resilient material is provided, which block is mounted directly or through a metal or synthetic part in the C-shaped slot 34 of the upper wall 25 of the guide rail 23.

FIG. 2 shows that the block 33 is provided with a recess 35, in which the ball-bearing 20 is received when the sliding door is slowed down towards its opened position.

FIG. 2 also shows two blocks 36 with oblique sides against which the ball-bearing 20 can run when the door is closed. As shown in FIG. 2, the rollers 19 are in the recesses.

As shown in FIG. 1, guide cams 37 can be provided on the floor 9 to maintain the door in its correct vertical position.

As apparent from FIG. 1, the guide rail 23 can be provided with round recesses 38. Pins can be inserted into these recesses to connect rail sections with one another. This is advantageous when a rail has to be extended or when a rail has to be supplied in two parts in connection with transportation or assembly. Because of the use of pins, there will also be less loss caused by cutting. Making the round recesses will in itself not cause problems, as the guide rail will usually be manufactured by extrusion-moulding, e.g. from aluminium.

Furthermore it may be observed that when a sliding door construction has to be provided with a device for the automatic opening and closing thereof, the parts of this device are mounted above the guide rail 23 and can be hidden from view by means of a second cover 28, which lies in the same plane above the first cover.

It will be obvious that only one possible embodiment of the invention has been represented in the drawing and described above, and that numerous modifications can be applied without departing from the scope of the invention.

I claim:

1. A sliding door construction for closing an opening in a wall, which door construction comprises:

(a) a door;

(b) a guide rail having a longitudinal V-shaped portion;

(c) a plurality of rollers carried by the upper edge of the door and disposed in the V-shaped portion for supporting the door on the guide rail for sliding movement along a plane parallel to and spaced from the wall;

(d) the V-shaped portion including recesses for engaging the rollers to move the door downwardly and towards the wall into a closed position;

(e) the upper edge of the door including a first C-shaped slot;

(f) a plurality of bolts, each bolt including a shaft portion and a head portion, with the head portions being disposed in the first C-shaped slot and the rollers being rotatably mounted on the shaft portions;

(g) at least one ball bearing carried by the upper edge of the door; and (h) means carried by the guide rail and engageable by the ball bearing for arresting the sliding movement of the door.

2. The door construction of claim 1 wherein the ball bearing is supported on the shaft portion of a bolt.

3. The door construction of claim 1 further including at least one extension pin, the guide rail including at least one longitudinal recess, and wherein the extension pin may be inserted within corresponding longitudinal recesses of adjacent guide rails for coupling same together.

4. The door construction of claim 1 further including a detachable cover for concealing the guide rail, the rollers and the upper edge of the door.

5. The door construction of claim 4 further including resilient means for detachably securing the cover to the guide rail.

6. The door construction of claim 4 wherein the cover includes at least one bent section for enclosing an end of the guide rail.

7. The door construction of claim 1 wherein the arresting means includes at least one block of resilient material.

8. The door construction of claim 7 wherein the block of resilient material includes an oblique side for engagement by the ball bearing.

9. The door construction of claim 7 wherein the block of resilient material includes a recess for engagement by the ball bearing.

10. The door construction of claim 7 wherein the guide rail further includes a second C-shaped slot and the block of resilient material is disposed within the second C-shaped slot.

* * * * *